United States Patent [19]

Bussan et al.

[11] Patent Number: 4,745,775

[45] Date of Patent: May 24, 1988

[54] REFRIGERATOR PAN ASSEMBLY

[75] Inventors: Marc R. Bussan, Knight Township, Vanderburgh County; Charles G. Fellwock, Scott Township, Vanderburgh County, both of Ind.

[73] Assignee: Whirlpool Corporation, Benton Harbor, Mich.

[21] Appl. No.: 946,899

[22] Filed: Dec. 29, 1986

[51] Int. Cl.[4] ..... F25D 25/02

[52] U.S. Cl. ..... 62/382; 62/408; 312/330 R

[58] Field of Search ..... 312/330; 62/382, 408, 62/441

[56] References Cited

U.S. PATENT DOCUMENTS

| | | | |
|---|---|---|---|
| 1,774,313 | 8/1930 | Braeutigam | 62/382 |
| 2,306,802 | 12/1942 | Harbison | 62/382 |
| 2,331,560 | 10/1943 | Maniscalco | 62/291 |
| 2,455,182 | 11/1948 | La Vallee | 62/382 X |
| 2,482,915 | 9/1949 | Kaboskey et al. | 62/408 |
| 2,711,944 | 6/1955 | Meek et al. | 62/382 |
| 2,929,228 | 3/1960 | Gould, Jr. | 62/382 |
| 3,241,334 | 3/1966 | Amore | 62/382 |
| 3,364,694 | 1/1968 | Cohen et al. | 62/265 |
| 3,473,345 | 10/1969 | Pfeiffer et al. | 62/408 |
| 4,013,434 | 3/1977 | Kronenberger et al. | 62/382 |
| 4,250,719 | 2/1981 | Grimm et al. | 62/382 |

*Primary Examiner*—Lloyd L. King

*Attorney, Agent, or Firm*—Wood, Dalton, Phillips, Mason & Rowe

[57] ABSTRACT

A storage pan assembly for a refrigerator, having a humidity control therein, uses only four parts which are assembled together free of any fasteners. A plastic slide member snaps into place in a baffle housing to provide an adjustable baffle. The baffle in turn is held in assembled relation with a front panel, using a latching hook disposed thereon. The front panel slidably mounts on flanges located at the front of a storage pan to provide a storage pan assembly. Openings are provided through the front panel and storage pan, at the baffle, to provide an adjustable air passageway therebetween.

18 Claims, 5 Drawing Sheets

FIG. 1
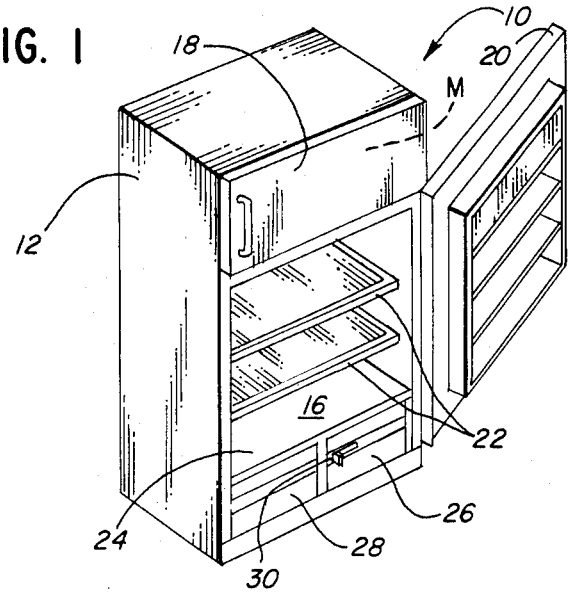
FIG. 7
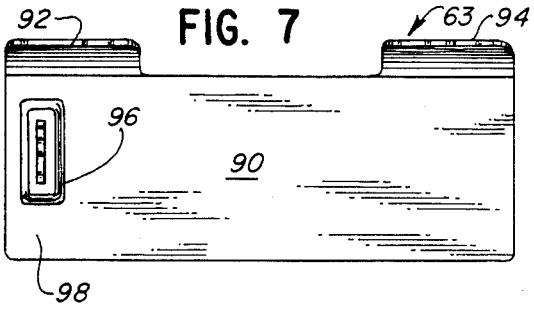
FIG. 8
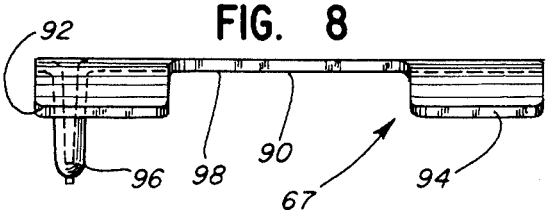
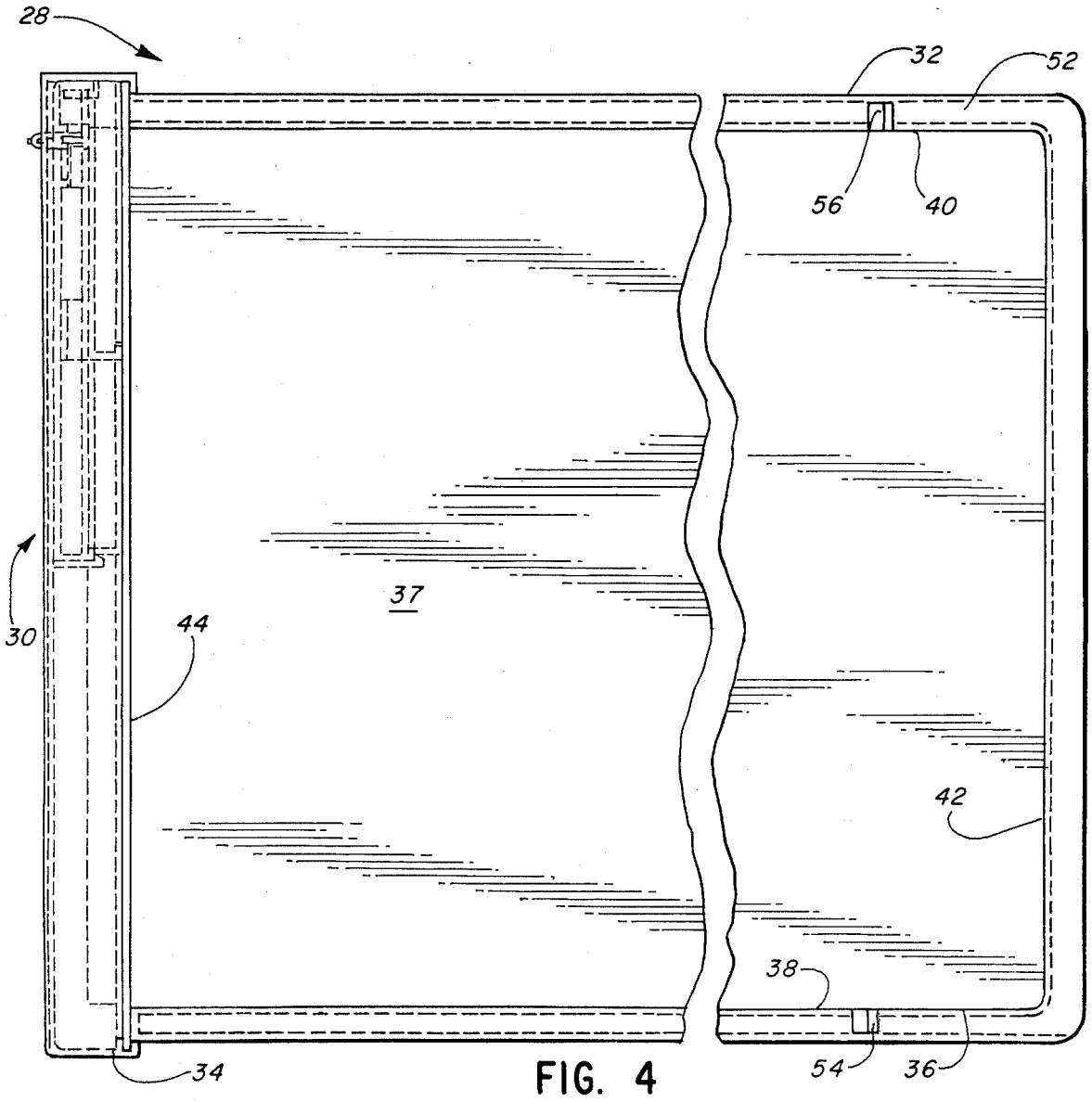
FIG. 4

FIG. 5
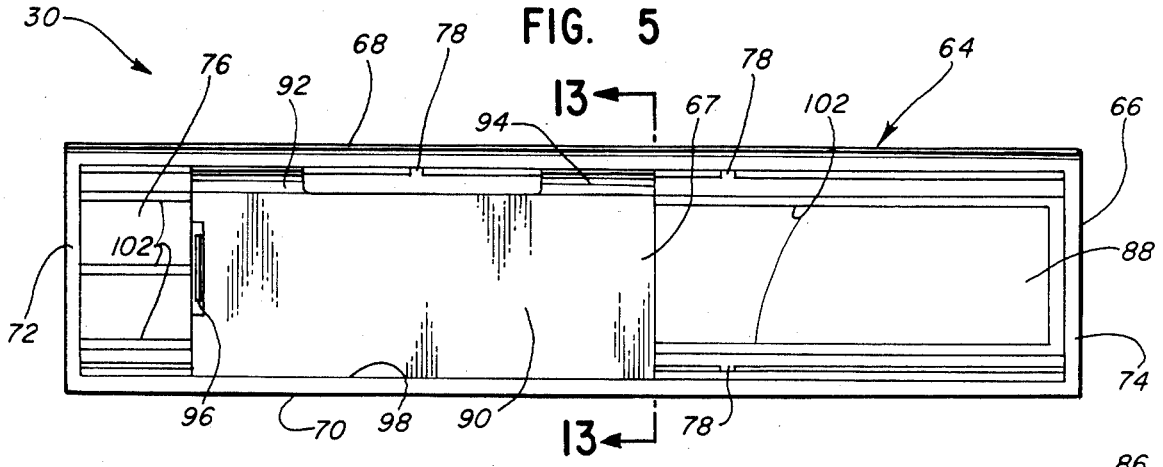
FIG. 6
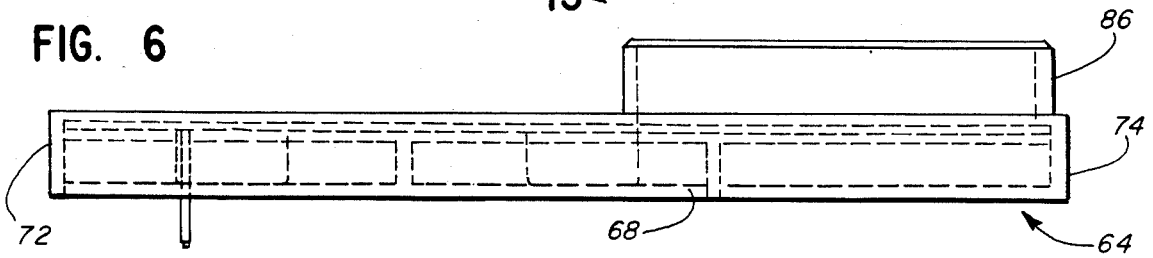
FIG. 9
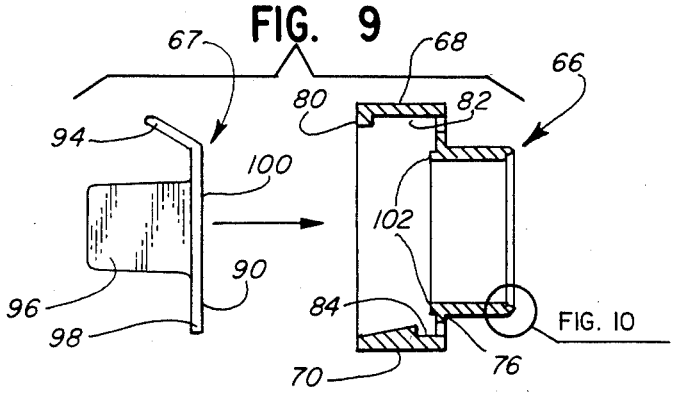
FIG. 11
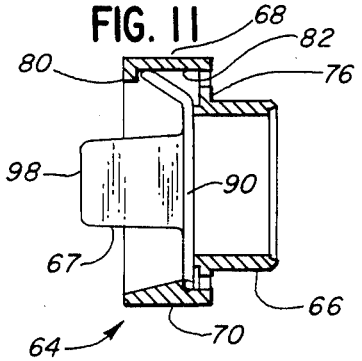
FIG. 12
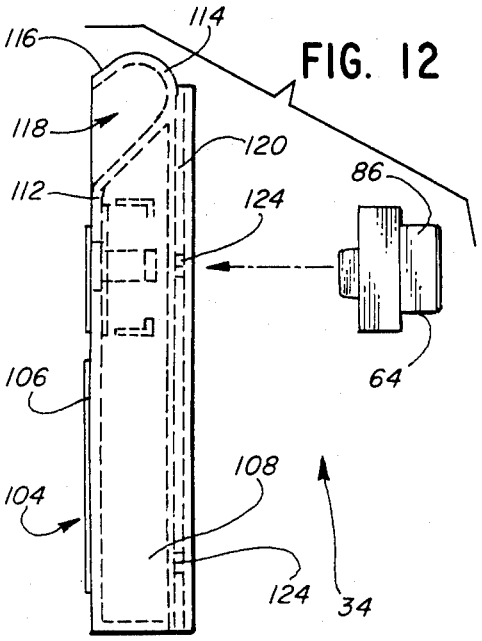
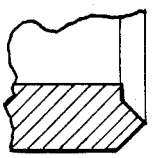
FIG. 10
FIG. 13
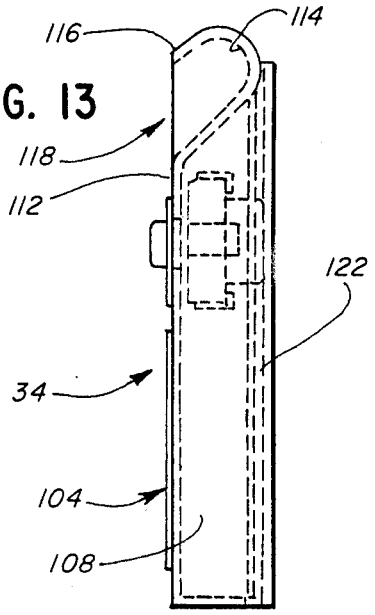

FIG. 19
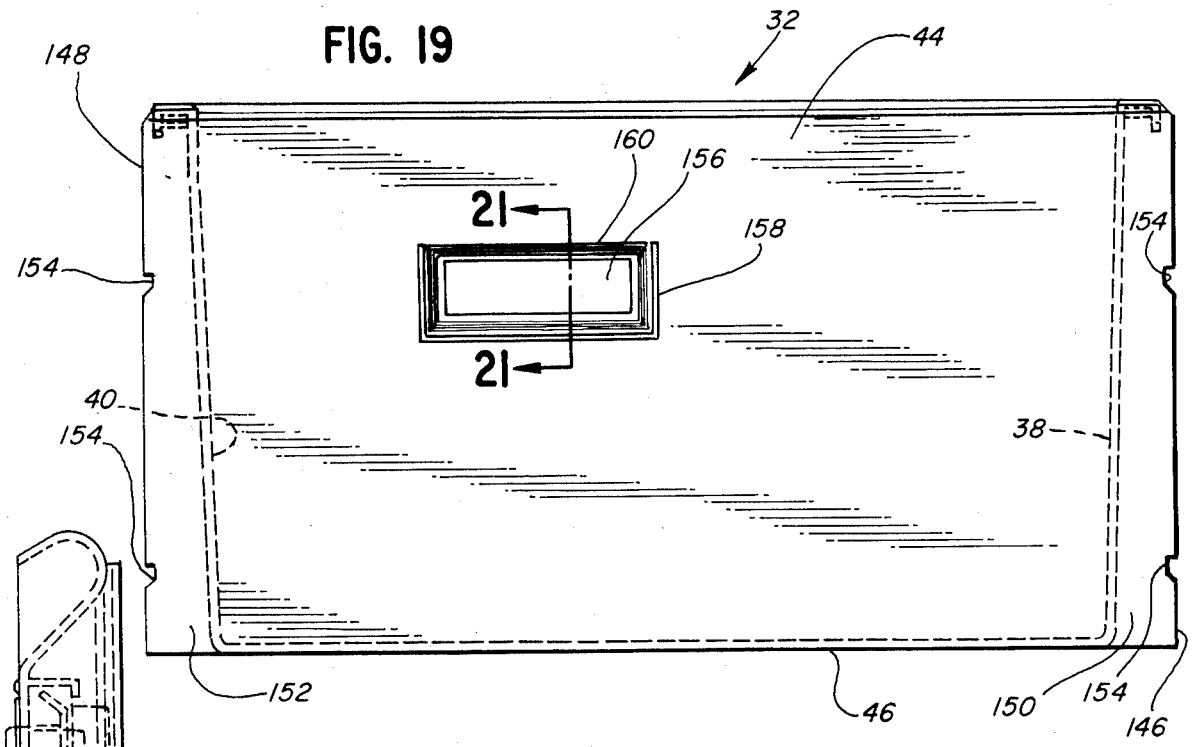
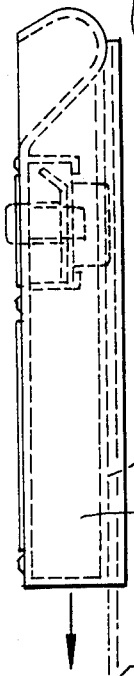
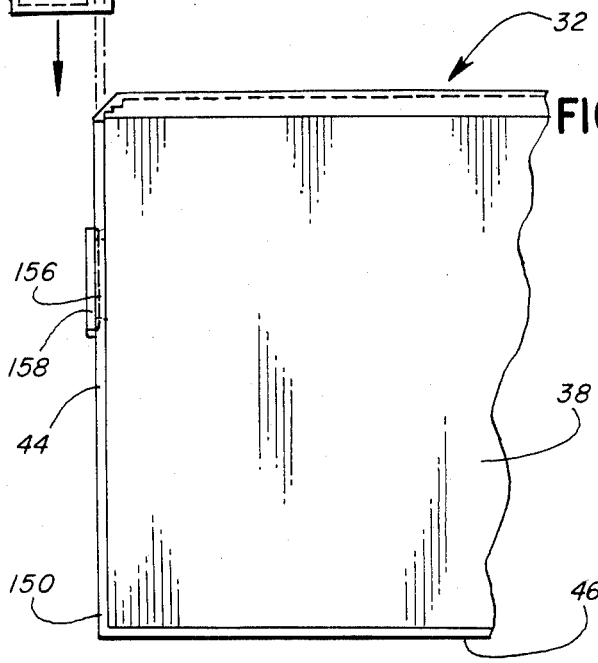
FIG. 20
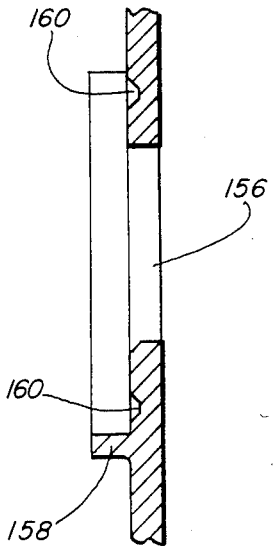
FIG. 21

REFRIGERATOR PAN ASSEMBLY

BACKGROUND OF THE INVENTION

1. Field of the Invention

This invention relates generally to refrigerators, and more particularly, to an improved refrigerator pan assembly.

2. Description of the Background Art

Conventional refrigerator pan assemblies are typically of one-piece construction or include a pan with a front panel fastened thereto with, for example, screws. The former structure is shown in Pfeiffer et al, U.S. Pat. No. 3,473,345. Such a one-piece construction results in a front face on the pan being of the same material, and thus color, as the remainder of the pan. It is desirable, however, in some instances, to provide a pan wherein the frontal appearance can be readily changed according to the particular model refrigerator within which it will be utilized. Thus, a single type pan may be utilized with different front panels, lowering inventory costs and providing economies of scale.

An alternative screw on front panel construction is shown in Harbison, U.S. Pat. No. 2,306,802. While such a construction permits variations in the particular style of front panel use, the use of necessary screws and washers causes the assembled pan to require a greater number of parts resulting in increased manufacturing costs.

The above-described problems with prior pan assemblies are magnified when it is desired to include a humidity control therewith. Known such crisper pans include a front assembly secured by screws to a pan. The front assembly consists of a slide which is fitted into a housing which in turn is screwed onto a front panel. A gasket is required between the housing and the pan to provide a sealed passageway therebetween. Such a humidity controlled pan again requires a substantial number of component parts. The cost of such components in addition to the manufacturing assembly time results in the pan assembly being unnecessarily expensive.

The present invention overcomes these and other problems of prior refrigerator pan assemblies, in a novel and simple manner.

SUMMARY OF THE INVENTION

In accordance with the present invention, a refrigerator pan assembly is provided which may be readily assembled in a novel and simple manner, utilizing relatively few components.

There is disclosed herein an improvement for a refrigeration apparatus. A storage pan defines an upwardly open top portion and a front portion. A panel is assembled to extend across the front portion of the storage pan free of any fastening means.

In the preferred embodiment, a plastic storage pan includes outwardly extending flanges at a front portion thereof. A front panel having a handle thereon includes a front wall and rearwardly extending side walls. Each side wall has an inwardly opening channel. The front panel is slidably assembled to the pan so that the flange rests in the channels. No fasteners are required to maintain the front panel in assembled relation with the pan.

The flange includes an edge having a plurality of notches. Corresponding projecting tabs are disposed within the channels of the front panel. When the front panel is assembled to the pan, the notches engage and coact with the tabs to maintain the front panel and pan in assembled relation.

In another embodiment, the front panel and storage pan are each provided with an opening therethrough. The openings are in substantial alignment. An adjustable baffle is disposed between the front panel opening and the pan opening to provide an adjustable air passageway therebetween. The adjustable baffle comprises a plastic slide which snaps into place in a plastic housing. The housing is assembled on an inner side of the front panel and is held in place with a rearwardly extending plastic hook. No fasteners are required to maintain the housing in assembled relation with the front panel.

An additional feature of the present invention is the use of a rectangular cross sectional tube disposed between the front panel opening and the pan opening. To provide a sealed air passageway, a groove is formed through the front face of the pan surrounding the opening therethrough. A distal edge of the tube extends into the groove to provide a seal between the tube and pan. The inner edge of the tube is preferably of V-shaped cross section, as is the groove.

Another feature of the present invention is the housing and tube being of one-piece construction. The housing and tube are of molded plastic such that the tube extends rearwardly from the housing.

Further features and advantages of the invention will readily be apparent from the specification and from the drawings.

BRIEF DESCRIPTION OF THE DRAWINGS

FIG. 1 is a perspective view of a refrigerator cabinet having the pan assembly embodying the invention;

FIG. 4 is a plan view of the pan of FIG. 2;

FIG. 5 is an elevational view of an adjustable baffle of the invention;

FIG. 6 is a plan view of the adjustable baffle of FIG. 5;

FIG. 7 is an elevational view of the slide member for the adjustable baffle;

FIG. 8 is a plan view of the slide member of FIG. 7;

FIG. 9 is an exploded view of the adjustable baffle;

FIG. 10 is a detailed view from the adjustable baffle of FIG. 9;

FIG. 11 is a sectional view taken along the lines 11—11 of FIG. 5;

FIG. 12 is an exploded view of the front panel assembly of the present invention;

FIG. 13 is a side elevational view of a front panel assembly of the present invention;

FIG. 19 is a front elevational view of the storage pan of the present invention;

FIG. 20 is an exploded view of the pan assembly of the present invention;

FIG. 21 is a sectional view taken along the lines 21—21 of FIG. 19.

DETAILED DESCRIPTION OF THE PREFERRED EMBODIMENTS

Figure 2:
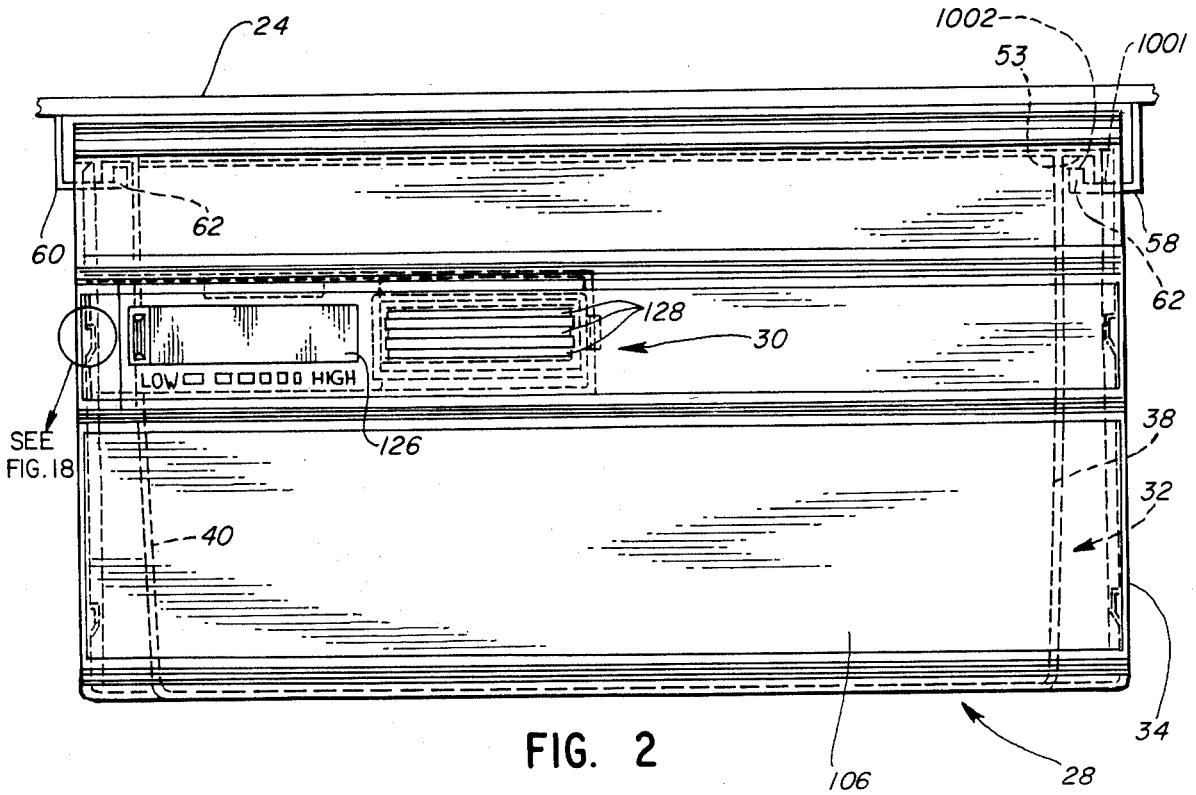
FIG. 2 is a front elevational view of the pan assembly embodying the invention.

Referring to FIG. 1, a refrigeration apparatus, such as a refrigerator/freezer 10 includes a pan assembly according to the present invention. The invention is shown utilized with a top freezer compartment and bottom refrigerator compartment; however, other types of refrigeration apparatus may be used in conjunction with the pan assembly of the present invention, as will be obvious to those skilled in the art.

The refrigerator/freezer 10 includes a cabinet 12 defining a below-freezing, or freezer compartment 14 and a fresh-food, or above-freezing compartment 16. A freezer door 18 and a fresh-food compartment door 20 are provided for selective access to the freezer and fresh-food compartments 14, 16, respectively.

The freezer and fresh-food compartments 14, 16 are cooled by circulating air therethrough which has been refrigerated as a result of being passed in heat exchange relation with a conventional evaporator (not shown). In addition to the evaporator, the refrigerator/freezer include connected components (not shown) such as a compressor, a condenser, a condenser fan, and an evaporator fan as will be obvious to those skilled in the art.

The fresh-food compartment 16 includes a plurality of upper shelves 22. Also provided in the fresh-food compartment is a lower shelf 24. In the preferred embodiment, the lower shelf 24 is of solid construction and may be, for example, high-strength glass or plastic.

A pair of storage pan assembly 26, 28, according to the invention are disposed within the fresh-food compartment 16 below the lower shelf 24. The storage pans 26, 28 are of similar construction. However, the latter storage pan 28 includes a humidity control 30 thereon. If desirable, both storage pans 26 and 28 could include a humidity control 30. The storage pan assembly 28 with the humidity control 30 provides a pan for the storage of foods such as vegetables and provides means to control the moisture content of the storage pan assembly to preserve freshness of the vegetables and prevent them from being prematurely damaged.

Figure 3:
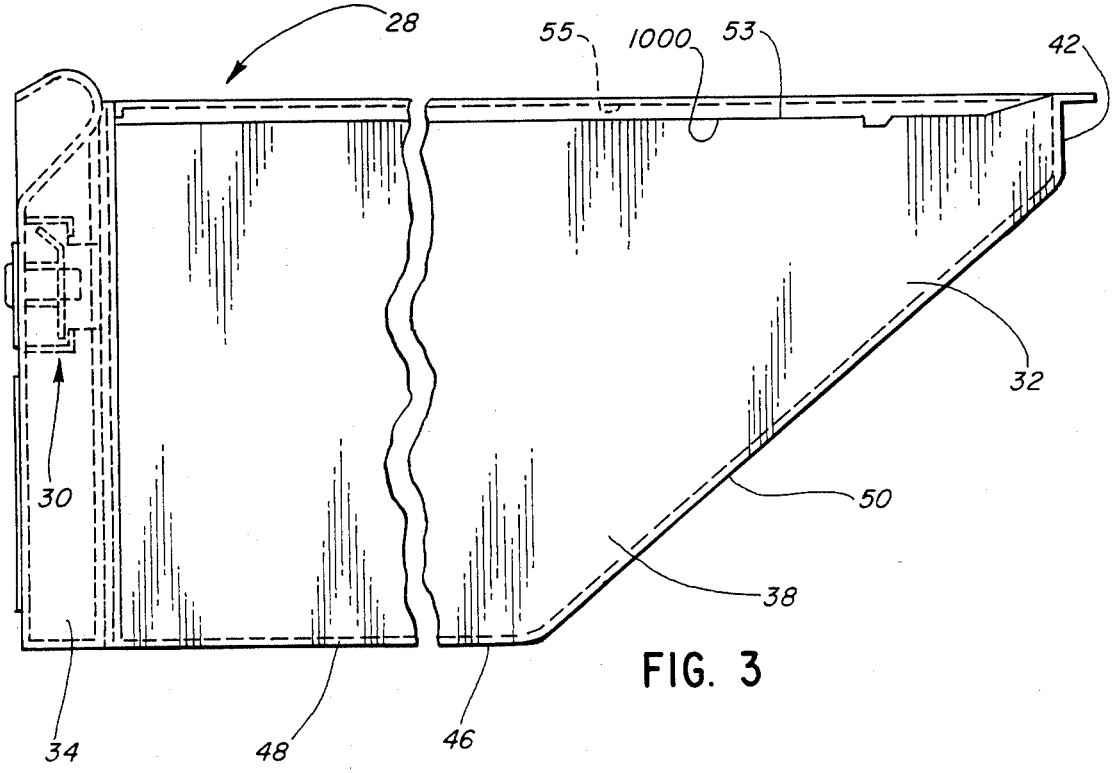
FIG. 3 is a side elevational view of the pan of FIG. 2.

The storage pan assembly 28 is illustrated in greater detail in FIGS. 2-4. The pan assembly 28 includes a storage pan 32 and a front panel assembly 34. The storage pan 32 has an upwardly open top portion 36 defining a storage cavity 37 wherein articles to be refrigerated may be stored. The storage pan 32 is preferably of molded plastic, although other materials may be used as will be obvious to those skilled in the art, and includes oppositely facing side walls 38 and 40, a rear wall 42, a front wall 44 and a bottom wall 46. The bottom wall 46 includes a front section 48 extending substantially rearwardly from the front wall 44 and a rear turned section 50 extending rearwardly and upwardly from the front section 46 to the rear wall 42. A continuous flange 52 extends outwardly from upper edges of the side walls 38, 40 and the rear wall 42. The portion of the flange along the sidewalls 38 and 40 includes a turned down portion 53 defining an underside 55. A pair of protruding stop members 54, 56 extends downwardly from the underside 55 of the flange 52, one each adjacent the side walls 38, 40, respectively.

As shown in FIG. 2, a pair of elongated L-shaped channel members 58, 60 are secured to and extend downwardly from the lower shelf 24. The channels 58 and 60 include upturned portions 62, 63. The pan assembly 28 is slidably supported in spaced relation to the shelf 24 by the upturned portions 62 and 63 of the channels 58 and 60 engaging the underside 55 of the flange 52 such that the pan assembly 28 may be slidably positioned within the fresh-food compartment 16. The stop members 54, 56 prevent the storage pan assembly 28 from being completely removed, unless the storage pan assembly 28 is raised sufficiently so that the stop members 54, 56 clear the upturned flanges 62 and 63.

The present invention could alternatively utilize roller bearings to slidably support the storage pan 28 in spaced relation with the shelf 24 and to further facilitate slidability therebetween as will be obvious to skilled in the art.

The humidity control 30 of the present invention is illustrated in greater detail in FIGS. 5-11, and comprises an adjustable baffle 64 which includes a housing 66 and a slide member 67. The housing 66 is preferably of molded plastic, although other known materials may also be used. The housing 66 comprises an upper wall 68, a lower wall 70, a first side wall 72, and a second side wall 74. A rear wall 76 extends between the side walls 72 and 74. The rear wall is also affixed to the upper and lower walls 68, 70 with bridging tabs 78. The upper wall 68 includes an inwardly extending ridge 80 at a front edge thereof defining an upper track 82. An inwardly opening channel 84 is formed in the lower wall 70 adjacent the rear wall 76 defining a lower track. A rectangular cross section tube 86 extends outwardly from an opening 88 in the rear wall 76 of the housing 66. The tube 86 includes a distal edge of V-shaped cross section as is shown in greater detail in FIG. 10.

The slide member 67 is of molded plastic and includes a planar portion 90 and first and second upwardly and outwardly extending guide members 92, 94. A slide handle 96 extends outwardly from a front face 98 of the planar portion 90.

As is illustrated in FIG. 9, the slide member 67 is placed forwardly of the housing 66 with the slide handle 96 extending away from the housing 66. The slide member 67 is inserted into the housing 66 in a snap action by inserting the lower edge 98 of the slide member 67 in the lower track 84, and subsequently swinging the upper guide members 92 and 94 into the upper track 82. The upper guide members 92 and 94 flex to permit such insertion. The assembled adjustable baffle 64 is illustrated in FIG. 11. A rear face 100 of the planar portion 90 of the slide member 67 bears on a plurality of raised ridges 102 extending inwardly from the rear wall 76 of the housing 66. With the fully assembled baffle 64, the slide member 67 may be slidably positioned laterally within the tracks 82, 84 of the housing 66. Thus, the size of the opening 88 may be controlled by selectively positioning the slide member 67.

The front panel assembly 34, including the adjustable baffle 64, is illustrated in greater detail in Figs. 12-17. A front panel 104 includes a decorative front wall 106 and first and second side walls 108 and 110. At an upper end 112 thereof, the front wall 106 turns inwardly and upwardly to a radially turned portion 114 ending in an outwardly and downwardly extending distal portion 116 to thereby define a handle 118. Each side wall 108, 110 includes an inwardly opening channel 120, 122, respectively. Each said channel 120, 122 includes two tabs 124 therein which protrude inwardly, see FIG. 18.

As illustrated in FIG. 2, the front wall 106 of front panel 104 is provided with a rectangular opening 126 therethrough. A plurality of slot openings 128 also extends through the front wall 106 adjacent the opening 126. The function of these openings 126 and 128 is discussed in greater detail below.

Figure 16:
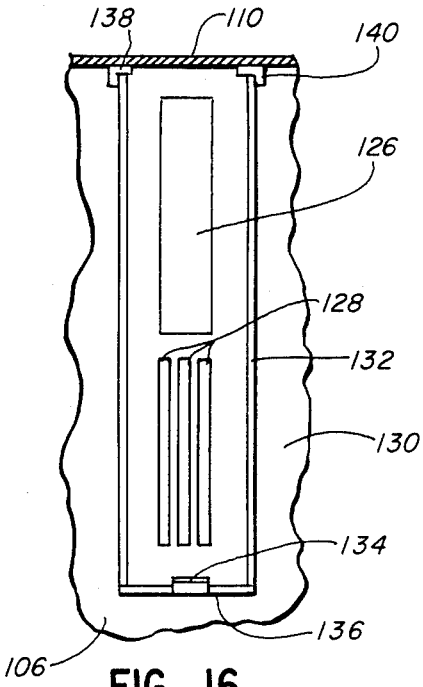
FIG. 16 is a sectional view taken along the lines 16—16 of FIG. 14.

As illustrated particularly in FIG. 16, a rear face 130 of the front wall 106 includes a rearwardly extending substantially U-shaped ridge 132. The ridge 132 surrounds the openings 126, 128 with the ends of the ridge 132 terminating at the side wall 110. The dimensions of the ridge are determined so as to coincide with the dimensions of the walls 68, 70, 72 and 74 of the baffle housing 66. A somewhat flexible latching hook 134 extends rearwardly from the rear face 130 of the front wall 106 at a mid-portion 136 of the U-shaped ridge 132.

Figure 17:
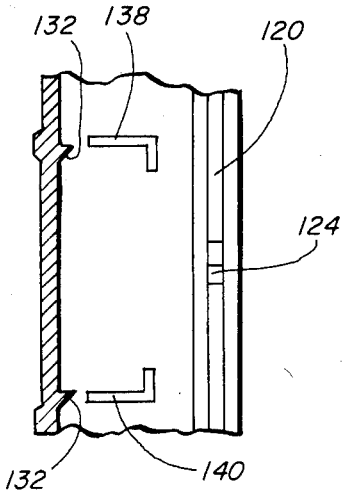
FIG. 17 is a sectional view taken along the lines 17—17 of FIG. 14.
Figure 18:
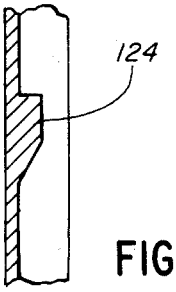
FIG. 18 is a detailed view of the pan assembly of FIG. 2.

As illustrated particularly in FIG. 17, the side wall 110 includes a pair of oppositely facing inwardly extending L-shaped ridges 138 and 140. The positioning of the L-shaped ridges 138, 140 on the side wall 110 corresponds with the positioning of the U-shaped ridge of the rear wall 130.

Figure 14:
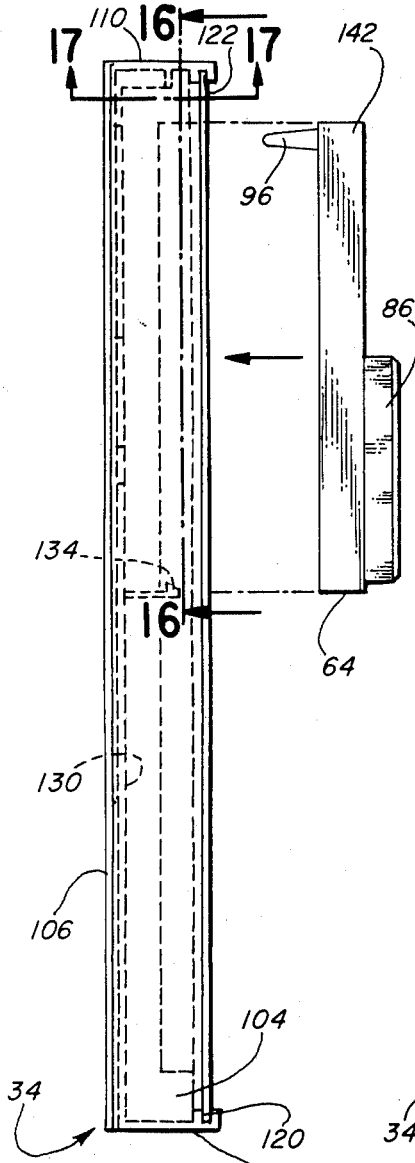
FIG. 14 is an exploded plan view of the front panel assembly of FIG. 12.
Figure 15:
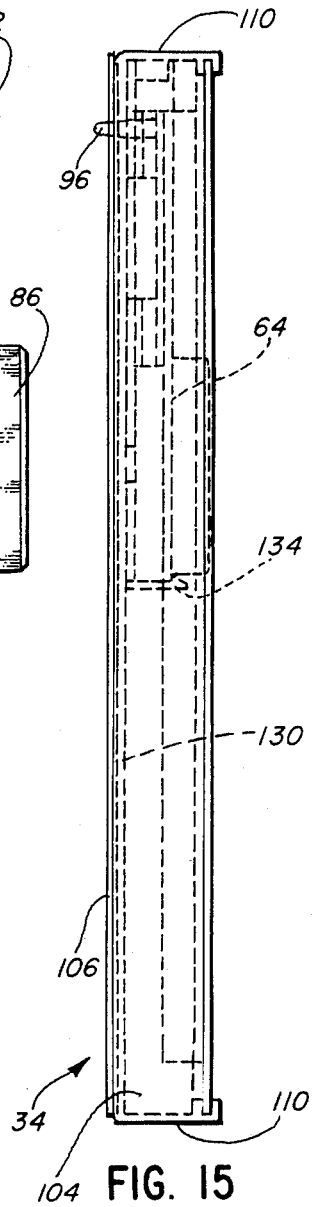
FIG. 15 is a plan view of the front panel assembly of FIG. 13.

As is illustrated particularly in FIGS. 12 and 14, during assembly the adjustable baffle 64 is placed rearwardly of the front panel 104 with the rectangular cross sectional tube 86 extending remotely from the front panel 104. An end 142 of the baffle 64 remote from the tube 86 is inserted inwardly of the first side wall 110 of the front panel between the L-shaped ridges 138, 140. The baffle 64 is then pivoted forwardly until it snaps into place under the latch hook 134. The front panel assembly 34 with the adjustable baffle 64 thereby installed is illustrated in FIGS. 13 and 15. Thus, the baffle 64 is held in place on the front panel 104 by the rear face 130 thereof, the U-shaped ridge 132, the L-shaped ridges 138 and 140, and the latching hook 134. Such an assembly is maintained free of any fastening means, such as screws, welds, adhesives, or the like.

With the adjustable baffle 64 assembled to the front panel 104, the slide handle 96 of slide member 67 extends outwardly through the front wall opening 126. As the slide member 67 is slidably positioned within the housing 64, the planar section 90 selectively restricts the size of the front panel openings 128.

As illustrated in FIG. 19, the front wall 44 of storage pan 32, in addition to the previous discussion related to FIGS. 2–4, includes side edges 146, 148. The edge 146 relative to the side wall 38 defines an outwardly extending flange 150 and the edge 148 relative to the side wall 40 defines an outwardly extending flange 152. Each flange 150, 152 includes a pair of notches 154 along its respective edge 146 and 148. An opening 156 extends through the front wall 44. The position of the opening 156 is in substantial alignment with the openings 128 through the front wall 106 of the front panel 104 when the front panel 104 is superimposed over the front wall 44 of the storage pan 32. The front wall 44 also includes an outwardly extending U-shaped ridge 158 surrounding three sides of the opening 156. An outwardly opening groove or recess 160 is formed through the front wall 44 about the periphery of the opening 156 therethrough, inwardly of the U-shaped groove 160.

As illustrated in FIG. 20, the front panel assembly 34 is placed forwardly and above the storage pan 32 with the inwardly opening channel 120 of side wall 108 directly above the storage pan flange 150. Although not shown, the other inwardly opening channel 122 of the side wall 110 is similarly located immediately above the flange 152. As indicated by the arrow, the front panel assembly 34 is moved downwardly in the assembly process with the flanges 150 and 152 being slidably disposed within the channels 120 and 122, respectively. The front panel assembly 34 is continually moved downwardly until the protruding tabs 124 engage the notches 154 of the flanges 150 and 152; causing slotted openings 128 of the front panel assembly 34 to be in substantial alignment with the opening 156 through the front wall 44 of the storage pan 32; and causing the distal edge of the rectangular cross sectional tube 86 to extend into the groove 160 disposed within the front wall 44 of the storage pan 32. As will be obvious to those skilled in the art, with the distal edge of the baffle tube 86 extending into the groove 160, a seal is provided without the need for an additional gasket therebetween. The completely assembled storage pan is thusly shown as previously described regarding FIGS. 2–4.

By slidably assembling the front panel 34 assembly with the storage pan 32 as described, the storage pan assembly 28 is maintained in assembled relation free of any fastening means, such as screws, welds, adhesives, or other such known fasteners. The complete assembly is attained utilizing only four component parts resulting in savings in material and labor costs.

The assembled storage pan provides a sealed air passageway which extends through the slotted openings 128 through the front wall 106 of the front panel 104, the baffle housing 66 and its associated rectangular cross sectional tube 86, and the opening 156 of the front wall 44 of the storage pan 32 into the storage pan space 37. By slidably positioning the slide member 67 of the adjustable baffle 64, the air passageway just described may be selectively restricted to control air flow into the storage pan space 37. When the storage pan assembly 28 is slidably disposed within the fresh-food compartment 16, as shown in FIG. 1, the bottom shelf 24 substantially closes off the opened top portion 36 of the storage pan assembly 28 when same is fully within the cabinet so that the humidity control 30 provides the primary inlet for refrigerated air to flow into the storage pan space 37. Thus, the humidity can be controlled by selectively slidably positioning the slide member 67 of the humidity control 30.

It should be appreciated that the storage pan 26 may be novelly and simply assembled as described herein without the humidity control 30 as will be obvious to those skilled in the art. Such a storage pan would eliminate the adjustable baffle 64 and the various openings through the front panel 104 and the storage pan front wall 44 resulting in a two-piece storage pan assembly.

Thus, the invention thoroughly comprehends a readily assemblable, novel and simple storage pan assembly which provides an aesthetically pleasing look while utilizing relatively few component parts and is simple to assemble.

The foregoing disclosure of the preferred embodiment is illustrative of the broad inventive concepts comprehended by the invention.

We claim:

1. In a refrigeration apparatus having a cabinet defining a refrigerated space, and a shelf in said space, a storage pan assembly comprising:

a storage pan defining an upwardly open top portion and a front portion having an outwardly extending flange;

means for supporting said pan in said cabinet refrigerated space; and a front panel including a handle, a front wall and rearwardly extending sidewalls, each said sidewall including an inwardly opening channel portion slidably mounted to said pan flange with said front wall extending across said front portion of the storage pan, the slidable mounting of said channel portion to said pan flange comprising the sole means for mounting said front panel to said storage pan.

2. The refrigeration apparatus of claim 1 wherein said flange includes notched portions and said channels include protruding tabs, wherein said protruding tabs coact with said notches to maintain said panel in assembled relation with said pan.

3. The refrigeration apparatus of claim 1 wherein said storage pan further includes a front wall wherein said storage pan further includes a front wall having an opening therethrough, and said front panel includes an opening therethrough in substantial alignment with said front wall opening.

4. The refrigeration apparatus of claim 3 further comprising an adjustable baffle disposed between said openings and further including means for mounting said baffle in association with said panel and said front wall free of any fastening means.

5. The refrigeration apparatus of claim 4 further comprising a rectangular cross sectional tube disposed between said adjustable baffle and said front wall opening defining a sealed air passageway therebetween.

6. The refrigeration apparatus of claim 3 further including a rectangular cross sectional tube disposed between said panel and said front wall and further including means associated with said tube for providing a sealed air passageway communicating between said panel opening and said front wall opening.

7. In a refrigeration apparatus having a cabinet defining a refrigerated space, and a shelf in said space, a storage pan assembly comprising:

a storage pan defining an upwardly open top portion and a front wall having an opening therethrough and including a pair of outwardly extending flanges;

means supporting said pan in said cabinet refrigerated space;

a front panel including a handle, a front wall and rearwardly extending sidewalls, each said sidewall including an inwardly opening channel portion slidably mounted to said pan flange with said front wall extending across said front portion of the storage pan, the slidable mounting of said channel portion to said pan flange comprising the sole means for mounting said front panel to said storage pan; and humidity control means mounted to said panel in overlying relationship to said opening for adjusting the effective cross section of said opening.

8. The refrigeration apparatus of claim 7 wherein said flanges include notched portions and said channels include protruding tabs, wherein said protruding tabs coact with said notches to maintain said panel in assembled relation with said pan so that said openings are in substantial alignment.

9. The refrigeration apparatus of claim 7 wherein said humidity control means comprises an adjustable baffle disposed between said openings and further including means integrally formed with said front panel for mounting said baffle in association with said panel and said front wall free of any fastening means.

10. The refrigeration apparatus of claim 9 wherein said humidity control means further comprises a rectangular cross sectional tube disposed between said adjustable baffle and said front wall opening defining a sealed air passageway therebetween.

11. The refrigeration apparatus of claim 7 wherein said humidity control means comprises a rectangular cross sectional tube disposed between said panel and said front wall and further including means associated with said tube for providing a sealed air passageway communicating between said panel opening and said pan opening.

12. In a refrigeration apparatus having a cabinet defining a refrigerated space, and a shelf in said space, a crisper pan assembly comprising:

a storage pan an defining upwardly open top portion and a front portion;

means for supporting said pan in said refrigerated space;

a front panel including a front wall and rearwardly extending sidewalls, said front panel having an opening therethrough;

means for mounting said front panel to said front portion of said pan;

an adjustable baffle; and resilient cooperating mounting means on said front panel and said baffle for mounting said baffle to said front panel at said opening, said baffle defining an adjustable air passage through said front panel opening.

13. The refrigeration apparatus of claim 12 wherein said storage pan further includes a front wall having an opening therethrough, said front wall opening being in substantial alignment with said baffle to provide an air passageway through said front panel opening, said baffle and said said front wall opening.

14. The refrigeration apparatus of claim 13 further comprising a rectangular cross sectional tube disposed between said adjustable baffle and said front wall opening defining a sealed air passageway therebetween.

15. In a refrigeration apparatus having a cabinet defining a refrigerated air space, and a shelf in said space, a crisper pan assembly comprising:

a storage pan defining an upwardly open top portion and a front wall having an opening therethrough and a pair of outwardly extending flanges;

means for supporting said pan in said refrigerated air space;

a front panel including a front wall having an opening therethrough, and a pair of rearwardly extending sidewalls each having an inwardly opening channel portion engaging one each of said flanges to maintain said front panel in assembled relation with said storage pan with said openings in substantial alignment;

a rectangular cross-section tube aligned between said front panel opening and said front wall opening; and sealing means on said tube, said front panel and said front wall for providing a sealed air passageway communicating between said front panel opening and said front wall opening through said tube.

16. The refrigeration apparatus of claim 15 wherein said providing means includes a groove in a front face of said front wall and wherein said tube has a distal edge which extends into said groove.

17. The refrigeration apparatus of claim 16 wherein said distal edge of said tube is of V-shaped cross-section.

18. The refrigeration apparatus of claim 15 further including baffle means associated with said tube for adjusting the opening of said passageway.

* * * * *